US009837220B2

(12) United States Patent
Hou et al.

(10) Patent No.: US 9,837,220 B2
(45) Date of Patent: Dec. 5, 2017

(54) KEYSWITCH STRUCTURE

(71) Applicants: DARFON ELECTRONICS (SUZHOU) CO., LTD., Suzhou (CN); DARFON ELECTRONICS CORP., Taoyuan County (TW)

(72) Inventors: Po-Chung Hou, Taoyuan County (TW); Sung-Fu Yang, Taoyuan County (TW)

(73) Assignees: DARFON ELECTRONICS (SUZHOU) CO., LTD., Suzhou (CN); DARFON ELECTRONICS CORP., Taoyuan County (TW)

( * ) Notice: Subject to any disclaimer, the term of this patent is extended or adjusted under 35 U.S.C. 154(b) by 0 days.

(21) Appl. No.: 15/149,443

(22) Filed: May 9, 2016

(65) Prior Publication Data

US 2016/0329166 A1 Nov. 10, 2016

(30) Foreign Application Priority Data

May 8, 2015 (TW) ..... 104114808 A

(51) Int. Cl.
*H01H 13/705* (2006.01)
*H01H 3/12* (2006.01)
*H01H 9/02* (2006.01)

(52) U.S. Cl.
CPC ..... *H01H 3/122* (2013.01); *H01H 13/705* (2013.01); *H01H 3/125* (2013.01); *H01H 2009/0278* (2013.01); *H01H 2217/004* (2013.01); *H01H 2217/016* (2013.01); *H01H 2221/062* (2013.01)

(58) Field of Classification Search
CPC ..... H01H 3/125; H01H 3/122; H01H 13/705; H01H 2009/0278; H01H 2217/004; H01H 2217/016; H01H 2221/062
USPC ..... 200/344
See application file for complete search history.

(56) References Cited

U.S. PATENT DOCUMENTS 6,683,264 B2 * 1/2004 Obara ..... H01H 3/125 200/292
7,683,280 B2 * 3/2010 Hsu ..... H01H 3/125 200/344
8,592,702 B2 * 11/2013 Tsai ..... G06F 3/0202 200/296
8,957,332 B2 * 2/2015 Yamada ..... H01H 3/125 200/344

(Continued)

*Primary Examiner* — Felix O Figueroa
(74) *Attorney, Agent, or Firm* — Innovation Capital Law Group, LLP; Vic Lin

(57) ABSTRACT

A keyswitch structure includes a keycap having a lower surface and an engaging portion protruding from the lower surface, the keycap moving to a lower position when the keycap is pressed, a linking bar coupled with the engaging portion, a distal end of the engaging portion being lower than the linking bar when the keycap moves to the lower position, a baseplate disposed below the keycap, the baseplate having a recessed space corresponding to the engaging portion, and a buffer film disposed on the baseplate, the buffer film substantially extending over the recessed space and having a deformable portion corresponding to the recessed space, wherein when the keycap moves toward the baseplate to the lower position, the distal end of the engaging portion pushes the deformable portion to make the deformable portion extend into the recessed space.

11 Claims, 14 Drawing Sheets

(56) References Cited

U.S. PATENT DOCUMENTS

| | | | | |
|---|---|---|---|---|
| 8,957,337 | B2 * | 2/2015 | Niu | H01H 3/125<br>200/344 |
| 2011/0056814 | A1 * | 3/2011 | Cheng | H01H 9/182<br>200/310 |

* cited by examiner

KEYSWITCH STRUCTURE

BACKGROUND OF THE INVENTION

1. Field of the Invention

The invention generally relates to a keyswitch structure. Particularly, the invention relates to a keyswitch structure of low noise design.

2. Description of the Prior Art

Keyboard devices generally have regular-sized keys and larger-sized keys, such as Space key, Enter key, Caps Lock key, Shift key. The larger-sized keys usually have one or more linking bars to enhance the strength of the keycap. Moreover, by means of the linking bar, when the user presses the keycap on the non-center portion, the larger-sized key is prevented from slanting during the pressing operation. The linking bar is generally connected to the engaging portion that protrudes from the lower surface of the keycap. When the user presses the keycap, the engaging portion protruding from the keycap will hit the baseplate and generate loud noise, impairing the operation smoothness and comfortability.

Therefore, how to effectively reduce the noise generated by the keycap hitting the baseplate is one of the major considerations for keyswitch design.

SUMMARY OF THE INVENTION

In view of the prior arts, it is an object of the invention to provide a keyswitch structure to effectively reduce the operation noise.

It is another object of the invention to provide a keyswitch structure of low noise design that can provide a buffer effect to eliminate or reduce noise generated by direct collision of key elements during operation.

It is yet another object of the invention to provide a keyswitch structure having a buffer design that utilizes the multi-layered membrane switch layer to effectively reduce noise without increasing the material cost.

In an embodiment, the invention provides a keyswitch structure including a keycap having a lower surface and an engaging portion protruding from the lower surface, the keycap moving to a lower position when the keycap is pressed, a linking bar coupled with the engaging portion, a distal end of the engaging portion being lower than the linking bar when the keycap moves to the lower position, a baseplate disposed below the keycap, the baseplate having a recessed space corresponding to the engaging portion, and a buffer film disposed on the baseplate, the buffer film substantially extending over the recessed space and having a deformable portion corresponding to the recessed space, wherein when the keycap moves toward the baseplate to the lower position, the distal end of the engaging portion pushes the deformable portion to make the deformable portion extend into the recessed space.

In an embodiment, the recessed space is a through hole or a groove formed on the baseplate.

In an embodiment, the buffer film is a membrane switch layer including at least one first type layer and at least one second type layer; the first type layer has an opening formed at location corresponding to the recessed space, and the second type layer extends over the recessed space to constitute the deformable portion.

In an embodiment, the deformable portion has a recessed groove; the recessed groove opens toward the keycap or the baseplate.

In an embodiment, the deformable portion has two recessed grooves, and the two recessed grooves open toward the keycap and the baseplate, respectively.

In an embodiment, the membrane switch layer includes multiple second type layers extending over the opening, and the total thickness of the second type layers is equal to or less than 0.075 mm.

In an embodiment, the buffer film includes a membrane switch layer and a sheet, wherein the membrane switch layer has a through hole corresponding to the engaging portion. The sheet extends over the through hole to serve as the deformable portion. When the keycap moves toward the baseplate, the engaging portion presses the sheet through the through hole to make the sheet extend into the recessed space.

In an embodiment, the sheet is a polyester sheet or a rubber sheet, and the thickness of the sheet is smaller than the thickness of the membrane switch layer.

In an embodiment, the linking bar includes a first linking bar and a second linking bar. The engaging portion includes at least one first engaging portion and a second engaging portion connected to the first linking bar and the second linking bar, respectively. The second linking bar is neighboring to the edge of the keycap, the first linking bar is neighboring to the center of the keycap, and the length of the first engaging portion is larger than or equal to the length of the second engaging portion.

In an embodiment, the keycap has a longitudinal axis; the linking bar has a middle section and two end sections extending from two ends of the middle section, respectively. The two end sections are neighboring to the opposite ends of the longitudinal axis and the middle section is neighboring to the center of the longitudinal axis, and the length of the first engaging portion connected to the middle section is larger than the length of the first engaging portion connected to the end section.

In an embodiment, the two end sections are positioned higher than the middle section, so the cross-section of the linking bar is curved as U-shaped.

DETAILED DESCRIPTION OF THE PREFERRED EMBODIMENT

The invention provides a keyswitch structure of low noise design and a keyboard having the keyswitch structure. Particularly, the keyswitch structure of the invention can be a keyswitch of the computer keyboard, but not limited thereto. The keyswitch structure of the invention can be a button, a numeral key, etc. of other electronic devices. The keyswitch structure of the invention can be any suitable keyswitch structure having an engaging portion, particularly a keyswitch structure having the engaging portion connected to the linking bar, such as larger-sized key of the keyboard, but not limited thereto. Hereafter, a computer keyboard is illustrated as an example to explain the details of the keyswitch structure of the invention.

Figure 1A:
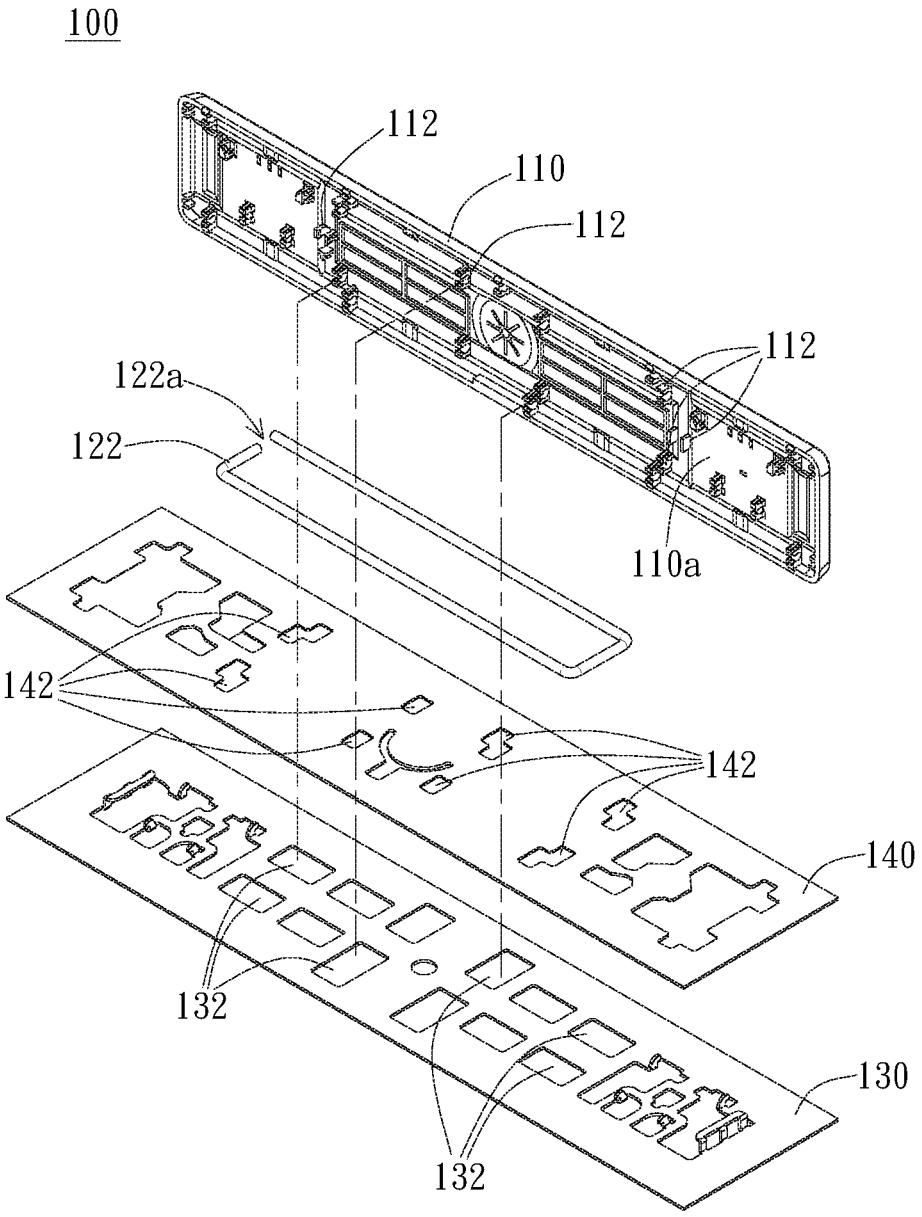
FIGS. 1A and 1B are an exploded view and a partial assembled view of the keyswitch structure according to an embodiment of the invention.
Figure 1B:
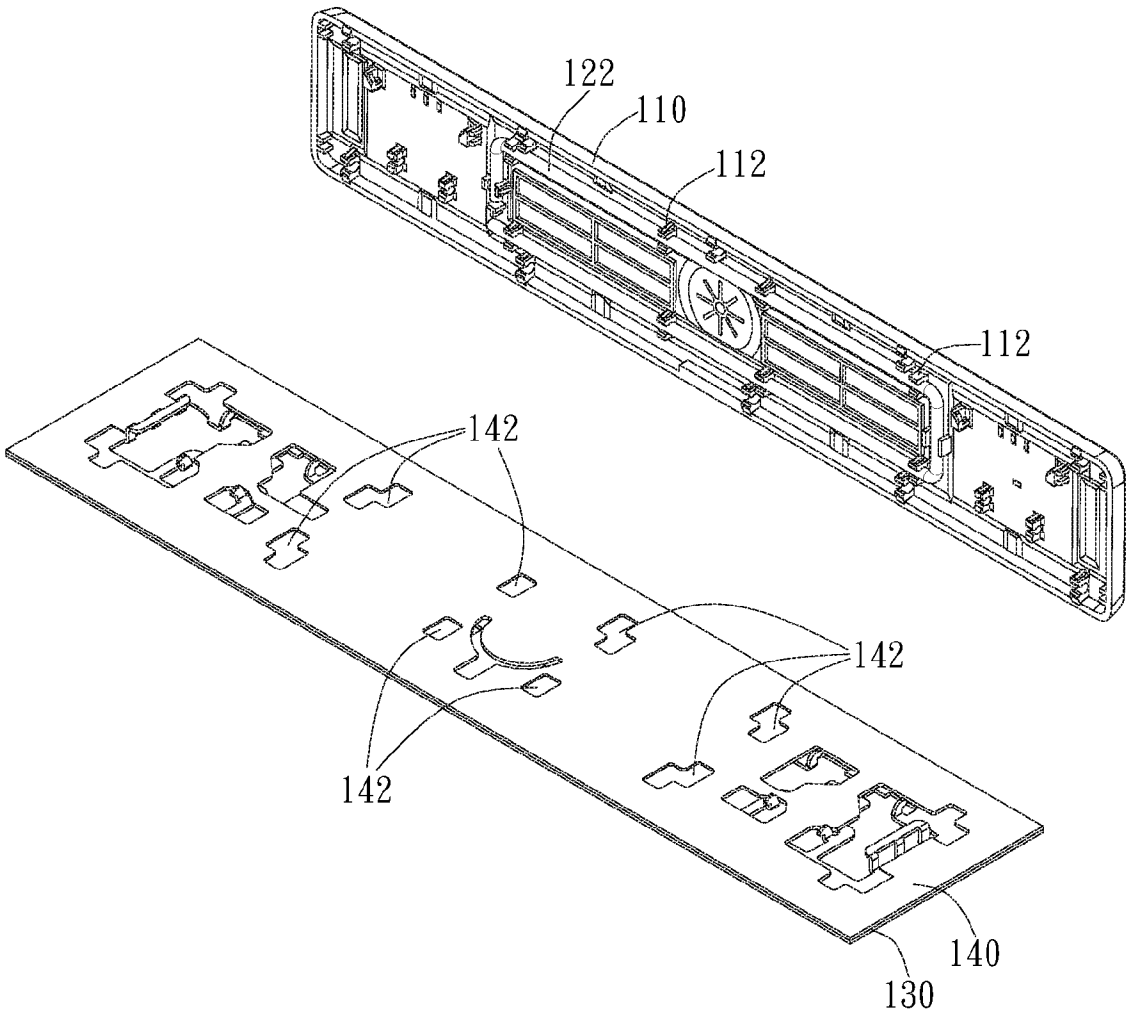
Figure 6A:
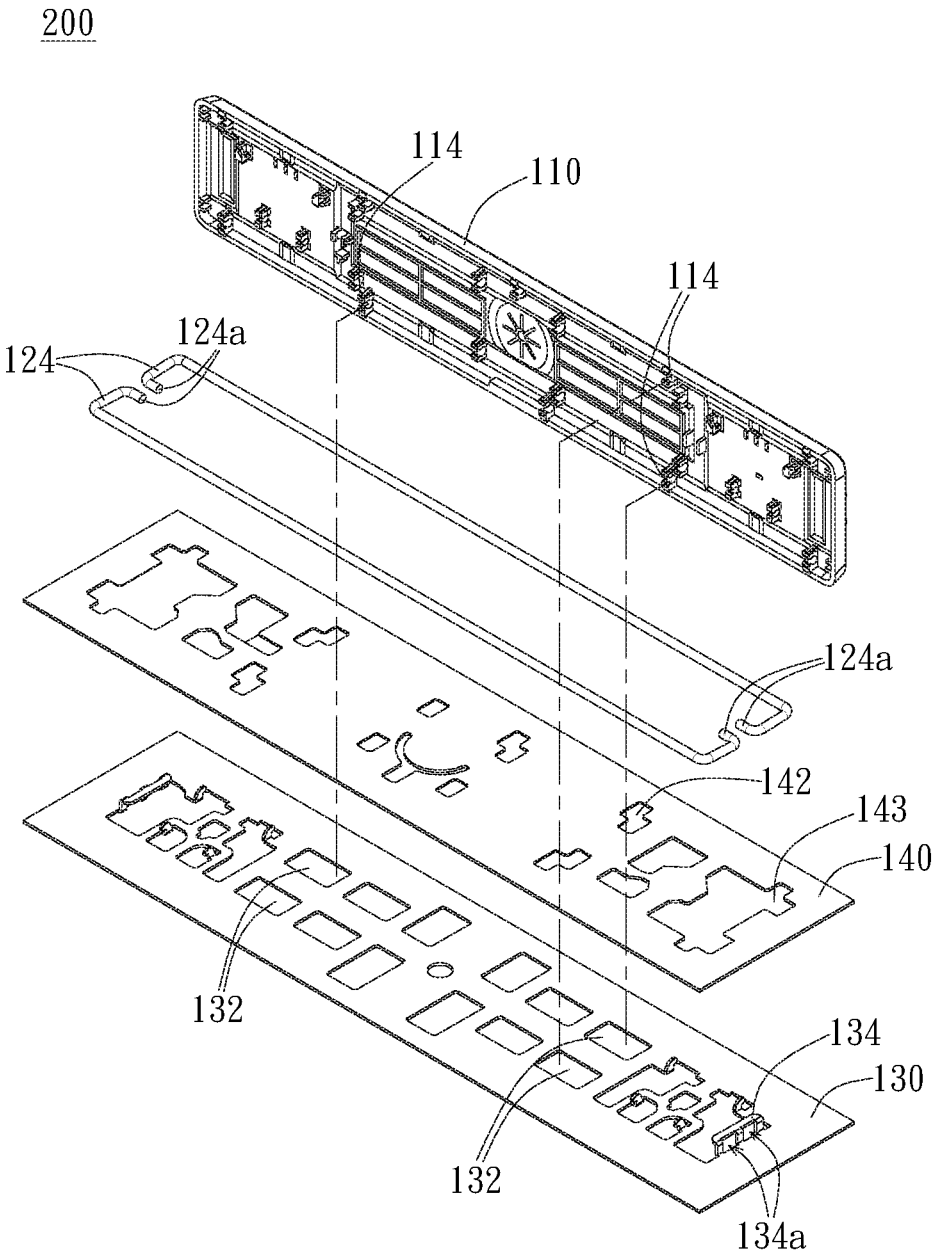
FIGS. 6A and 6B are an exploded view and a partial assembled view of the keyswitch structure according to another embodiment of the invention.

As shown in FIGS. 1A and 6A, in an embodiment, the keyswitch structure 100/200 of the invention includes a keycap 110, a linking bar 122/124, a baseplate 130, and a buffer film 140. The keycap 110 is disposed over the baseplate 130 and is downward/upward movable relative to the baseplate 130. The linking bar 122 is connected to the keycap 110, wherein the linking bar 122/124 generally has the following functions: (1) as shown in FIG. 1A, to enhance the structural strength of the keycap 110, or (2) as shown in FIG. 6A, to improve the linking effect of the keycap 110, so that when the user presses the keycap on the right side, the whole keycap including the left side can descend simultaneously to prevent the keycap 110 from exhibiting a slant state with the left side higher and the right side lower. The buffer film 140 is disposed on the baseplate 130 to provide the impact absorption effect when the keycap 110 moves toward the baseplate 130 (as described later). It is noted that the keyswitch structure 100/200 may further include other components, such as a support mechanism (e.g. scissors-like support, a butterfly-like support) to support the keycap 110 moving relative to the baseplate 130 and a restoring unit including elastic restoring unit such as rubber dome or magnetic restoring unit such as magnets to provide the restoring force, making the keycap 110 return to its original position after being pressed, which are not shown in the drawings.

In the embodiment of FIG. 1A, the linking bar 122 is only connected to the keycap 110 to increase the structural strength of the keycap 110. The linking bar 122 is preferably a frame-like linking bar defining a non-closed loop. For example, the linking bar 122 can have a rectangular shape and an opening 122*a* is formed between two ends of the linking bar 122 to increase the deformability of the linking bar 122 and improve the assembly convenience as the linking bar 122 is to be connected to the keycap 110. Moreover, the linking bar 122 preferably has a circular cross section for the bar body and can be formed by bending a metal line, but not limited thereto. In other embodiments, the bar body of the linking bar 122 may have an oval or square-shaped cross section, and the linking bar 122 can be made from any suitable materials to enhance the strength of the keycap 110 according to the design requirements.

Figure 2A:
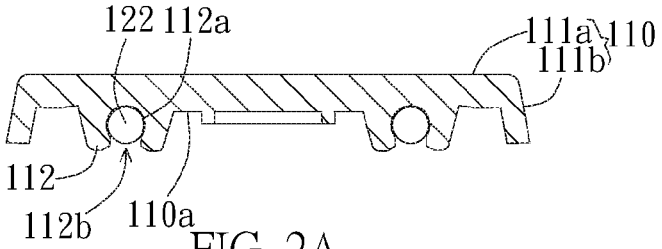
FIGS. 2A and 2B are schematic views of the engaging portion according to different embodiments of the invention.

The keycap 110 has an engaging portion 112 for coupling with the linking bar 122. In this embodiment, the keycap 110 has a plurality of engaging portions 112, wherein the plurality of engaging portions 122 are disposed on the lower surface 110*a* of the keycap 110 and correspond to the frame-shaped linking bar 122 to respectively couple with the corresponding portions of the linking bar 122. In other words, the plurality of engaging portions 112 are distributed in a frame shape on the lower surface 110*a* of the keycap 110. Moreover, the engaging portion 112 protrudes from the lower surface 110*a* of the keycap 110. As shown in FIG. 2A, the keycap 110 includes a key top 111*a* and a key skirt 111*b* encirclingly connected to the key top 111*a*. The engaging portion 112 protrudes from the lower surface 110*a* of the key top 111*a* and extends downwardly beyond the bottom surface of the key skirt 111*b*. As such, a distal end of the engaging portion 112 protrudes beyond the bottom surface of the key skirt 111*b*. That is, the distal end of the engaging portion 112 is the end of the engaging portion 112 that is far away from the lower surface 110*a* of the keycap 110.

In an embodiment, as shown in FIG. 2A, the engaging portion 112 is a hook-like structure having an engaging groove 112*a*, and the engaging groove 112*a* has a groove opening 112*b* at the distal end (i.e. the end that is far away from the lower surface 110*a*) of the hook-like structure. The groove opening 112*b* allows the bar body of the linking bar 122 to enter the engaging groove 112*a* to couple with the engaging portion 112. When the linking bar 122 enters the engaging groove 112*a* from the groove opening 112*b* to engage with the engaging groove 112*a*, the distal end of the engaging portion 112 is lower than the bottom of the linking bar 122. In other words, in this embodiment, the depth of the engaging groove 112*a* (i.e. the distance from the distal end of the engaging portion to the bottom of the engaging groove) is larger than the diameter or thickness of the linking bar 122, which is measured along the direction parallel to a virtual straight line running through the keycap 110 to the baseplate 130, i.e. the vertical direction, so that the bar body of the linking bar 122 can be substantially fully received in the engaging groove 112*a*. That is, the portion of the linking bar 122 that couples with the engaging portion 122 substantially does not protrude out of the engaging groove 112*a*, so that the distal end of the engaging portion 112 is lower than the portion of the linking bar 122 that couples with the engaging portion 122. In this embodiment, the width of the groove opening 112*b* is preferably smaller than the diameter of the bar body of the linking bar 122, which is measured along the horizontal direction. Consequently, when the linking bar 122 enters the engaging groove 112*a* and couples with the engaging portion 112, the movement of the linking bar 122 out of the engaging opening 112*b* can be restricted to prevent the detachment of the linking bar 122 from the engaging portion 112. Moreover, the sidewall of the engaging portion 112 that defines the engaging groove 112*a* preferably has an appropriate thickness to provide the deformability and promote the convenience of connecting the linking bar 122 to the engaging portion 112. In other words, when the linking bar 122 enters the engaging groove 112*a* from the groove opening 112*b*, the sidewall of the engaging portion 112 that defines the engaging groove 112*a* can elastically expand outward to facilitate the entrance of the linking bar 122 into the engaging groove 112*a*.

Figure 2B:
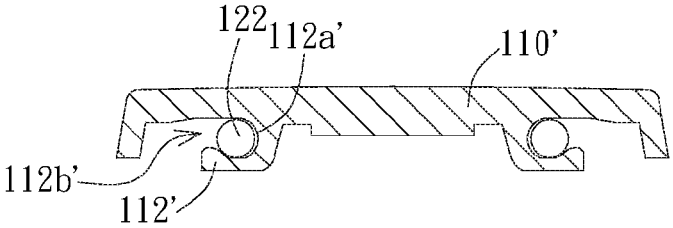

It is noted that FIG. 2A illustrates the linking bar 122 entering the engaging groove 112*a* from the distal end of the engaging portion 112 (i.e. from the bottom surface of the engaging portion 112) to couple with the engaging portion 112, but not limited thereto. In another embodiment, as show in FIG. 2B, the groove opening 112*b*' can be formed on the side surface of the engaging portion 112', so that the linking bar 122 can enter the engaging groove 112*a*' from the side of the engaging portion 112' to couple with the engaging portion 112'.

Figure 1C:
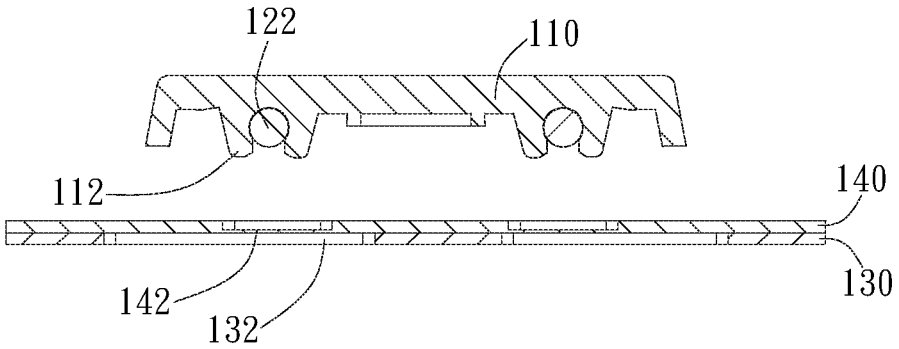
FIGS. 1C and 1D are schematic views of FIG. 1A before and after the keyswitch structure is pressed, respectively.
Figure 3:
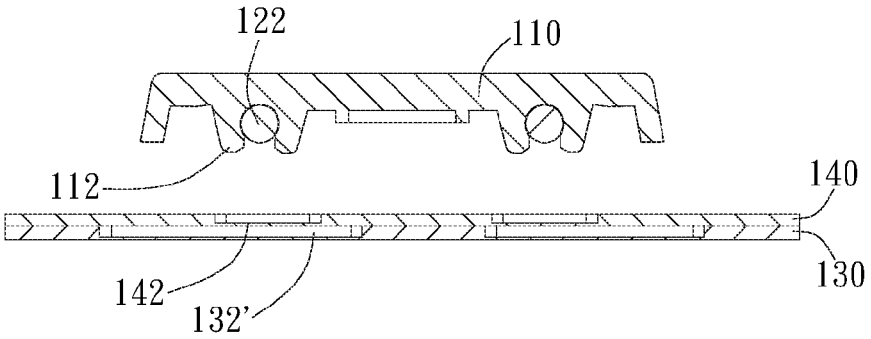
FIG. 3 is schematic view of the baseplate according to another embodiment of the invention.

Furthermore, the baseplate 130 is disposed below the keycap 110, and the baseplate 130 has a recessed space 132 corresponding to the engaging portion 112 of the keycap 110. In this embodiment, the recessed space 132 is preferably a through hole formed on the baseplate 130 (as shown in FIG. 1C), but not limited thereto. In another embodiment, as shown in FIG. 3, the recessed space 132' can be a groove or blind hole formed on the baseplate 130. When the keycap 110 moves toward the baseplate 130, the recessed space 132 provides an escaping room for the engaging portion 112, so that the engaging portion 112 can move into the recessed space 132. In this embodiment, the baseplate 130 is preferably a metal plate, but not limited thereto.

As shown in FIGS. 1A and 1C, the buffer film 140 is disposed on the baseplate 130, wherein the buffer film 140 substantially extends over the recessed space 132, and the buffer film 140 has a deformable portion 142 corresponding to the recessed space 132. That is, the deformable portion 142 substantially covers the recessed space 132 as the buffer film 140 is disposed on the baseplate 130. In general, the deformable portion 142 can be formed by modifying the thickness, material, or shape thereof to have a greater deformability relative to other portions of the buffer film 140. For example, the deformable portion 142 can be (a) a portion of the buffer film 140 that has a relatively thinner thickness, (b) a portion of the buffer film 140 that has a relatively softer material formed by ejection molding or adhering, or (c) a portion of the buffer film 140 that has a shape susceptible to deformation, such as a tongue-like portion with only one end connected to the buffer film 140.

Figure 1D:
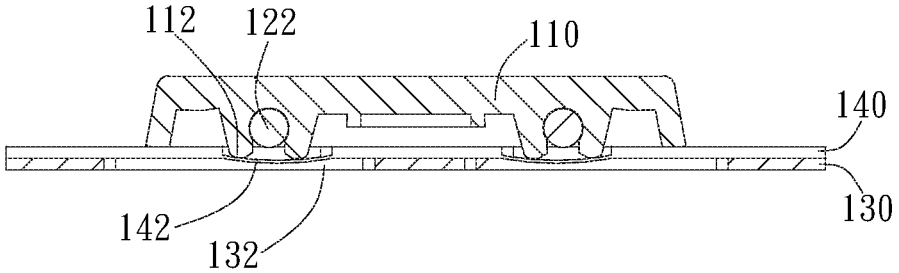

In a preferred embodiment, the deformable portion 142 of the buffer film 140 is a portion having a relatively thinner thickness, so that the deformable portion 142 has a greater elastic deformability compared to the other portions of the buffer film 140. With the deformable portion 142, the buffer film 140 can be designed to have a thicker thickness at most portions other than the deformable portion 142, so that the buffer film 140 is less breakable to increase the manufacturability. In this embodiment, the thickness of the deformable portion 142 is preferably equal to or less than 0.075 mm, but not limited thereto. The deformable portion 142 of the buffer film 140 preferably covers on the recessed space 132, and the rest of the buffer film 140 (i.e. the portions of the buffer film 140 other than the deformable portion 142) covers on the surface of the baseplate 130 around the recessed space 132. Accordingly, when the engaging portion 112 of the keycap 110 moves downwardly, the deformable portion 142 can deform to provide the buffering effect to reduce the impact noise. As shown in FIG. 1D, when the keycap 110 is pressed, the keycap 110 will move to a lower position. That is, when the keycap 110 moves toward the baseplate 130 to the lower position, the distal end of the engaging portion 112 is lower than the linking bar 122 and pushes the deformable portion 142 to make the deformable portion 142 extend into the recessed space 132. Particularly, when the keycap 110 moves toward the baseplate 130, the engaging portion 112 protruding the bottom surface of the key skirt 111*b* of the keycap 110 will hit the deformable portion 142 of the buffer film 140 first, and the deformable portion 142 then deforms downwardly and extends into the recessed space 132 of the baseplate 130. By such a design, without increasing the key height, the keyswitch structure 100 provides the engaging portion 112 of the keycap 110 with enough space for moving downward, and the deformable portion 142 of the buffer film 140 serves like a bouncing pad to absorb the impact noise generated by the engaging portion 112.

In a preferred embodiment, the buffer film 140 is a membrane switch layer, wherein a portion of the membrane switch layer is partially hollowed out to form a blind hole and serves as the deformable portion 142. Particularly, the membrane switch layer consists of multiple layers, wherein at least one layer of the membrane switch layer is formed with an opening corresponding to the recessed space 132, and at least another layer of the membrane switch layer substantially extends over the opening to constitute the deformable portion 142. In other words, the membrane switch layer includes at least one first type layer and at least one second type layer, wherein the first type layer has the opening formed at location corresponding to the recessed space 132, and the second type layer extends over the recessed space to constitute the deformable portion 142. The total thickness of the portion of the second type layer extending over the opening (i.e. the deformable portion) is preferably equal to or less than 0.075 mm.

Figure 4A:
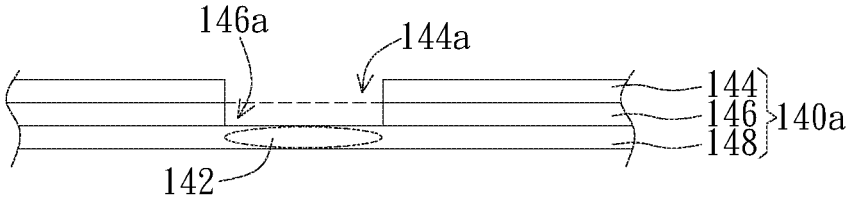
FIGS. 4A to 4E are schematic views of the membrane switch layer serving as the buffer film according to different embodiments of the invention.

For example, as shown in FIG. 4A, in an embodiment, the membrane switch layer 140*a* is a three-layered structure, wherein the first layer 144 and the third layer 148 are circuit layers, and the second layer 146 disposed between the first layer 144 and the third layer 148 is a spacer layer to isolate both circuit layers 144 and 148. When the keycap 110 moves toward the baseplate 130 to trigger the membrane switch layer 140*a*, the conductor pads formed on the first layer 144 and the third layer 148 contact each other to output the trigger signal. In this embodiment, the first layer 144 and the second layer 146 are the first type layer and have openings 144*a* and 146*a* formed right above the recessed space 132, respectively. That is, the openings 144*a* and 146*a* are formed at location corresponding to the recessed space 132. The openings 144*a* and 146*a* are aligned and communicate with each other. The third layer 148 is the second type layer that extends beneath the opening 146*a* to constitute the deformable portion 142, i.e. the third layer 148 covers the opening 146*a* from the bottom side, wherein the membrane switch layer 140*a* has a recessed groove on the top side, and the recessed groove opens toward the keycap 110 (i.e. a downward concave portion). In other words, the portion of the third layer 148 that corresponds to the openings 144*a*, 146*a* is the deformable portion 142, which receives the engaging portion 112 and provides the buffering effect. The thickness of the deformable portion 142 equals to the thickness of the third layer 148.

Figure 4B:
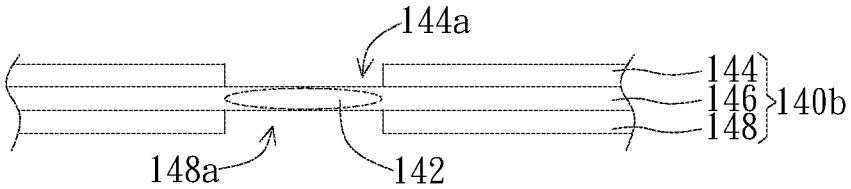

It is noted that when the buffer film is a membrane switch layer, the deformable portion 142 may have different configurations by manipulating the multiple-layered structure of the membrane switch layer, not limited to the embodiment of FIG. 4A. In another embodiment, as shown in FIG. 4B, the first layer 144 and the third layer 148 of the membrane switch layer 140*b* are the first type layer and respectively have openings 144*a* and 148*a* formed at location corresponding to (i.e. right above) the recessed space 132. The openings 144*a* and 148*a* do not communicate with each other and are separated by the second layer 146. That is, the second layer 146 is the second type layer that extends between the openings 144*a* and the 148*a* to constitute the deformable portion 142. The membrane switch layer 140*b* has two recessed grooves on the top side and the bottom side, respectively. The upper recessed groove constituted by the opening 144*a* and positioned above the second layer 146 opens toward the keycap 110 (i.e. a downward concave groove), and the recessed groove constituted by the opening 148*a* and the positioned below the second layer 146 opens toward the baseplate 130 (i.e. an upward concave groove). In this embodiment, the portion of the second layer 146 that corresponds to the openings 144*a*, 148*a* is the deformable portion 142, which receives the engaging portion 112 and provides the buffering effect. The thickness of the deformable portion 142 equals to the thickness of the second layer 146

Figure 4C:
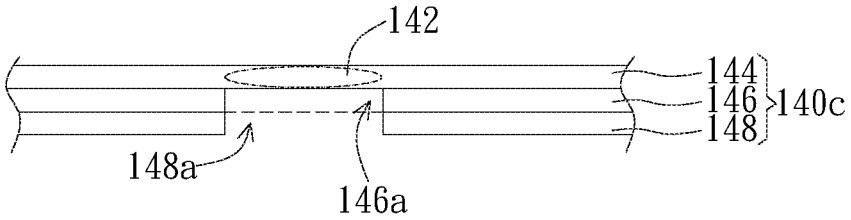

In another embodiment, as shown in FIG. 4C, the second layer 146 and the third layer 148 of the membrane switch layer 140*c* are the first type layer and have openings 146*a* and 148*a* formed right above the recessed space 132, respectively. That is, the openings 146*a* and 148*a* are formed at location corresponding to the recessed space 132. The openings 146*a* and 148*a* are aligned and communicate with each other. The first layer 144 is the second type layer that extends over the opening 146*a* to constitute the deformable portion 142, i.e. the first layer 144 covers the opening 146*a* from the top side, wherein the membrane switch layer 140*c* has a recessed groove on the bottom side, and the recessed groove opens toward the baseplate 130 (i.e. an upward concave portion). In other words, the portion of the first layer 144 that corresponds to the openings 146*a*, 148*a* is the deformable portion 142, which receives the engaging portion 112 and provides the buffering effect. The thickness of the deformable portion 142 equals to the thickness of the first layer 144.

Figure 4D:
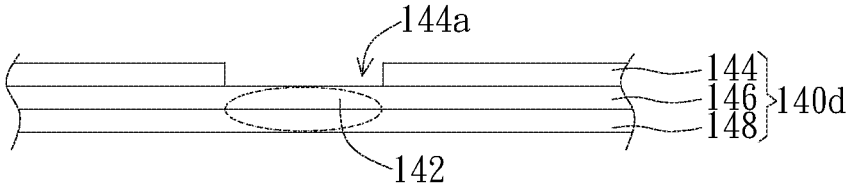

In another embodiment, as shown in FIG. 4D, the first layer 144 of the membrane switch layer 140*d* is the first type layer and has an opening 144*a* formed at location corresponding to the recessed space 132 (i.e. right above the recessed space 132). The second layer 146 and the third layer 148 are the second type layers that extend beneath the opening 144*a* to constitute the deformable portion 142, wherein the membrane switch layer 140*d* has a recessed groove on the top side, and the recessed groove opens toward the keycap 110. In other words, the portions of the second layer 146 and the third layer 148 that correspond to the opening 144*a* are the deformable portion 142, which receives the engaging portion 112 and provides the buffering effect. The thickness of the deformable portion 142 equals to the total thickness of the second layer 146 and the third layer 148 (i.e. the total thickness of the second type layers) and preferably equals to or less than 0.075 mm.

Figure 4E:
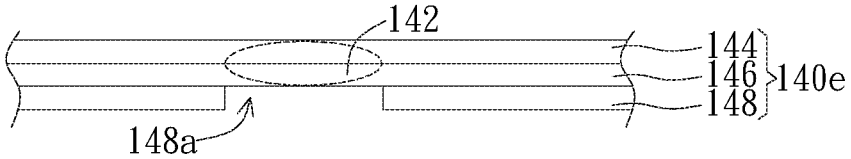

In another embodiment, as shown in FIG. 4E, the third layer 148 of the membrane switch layer 140*e* is the first type layer and has an opening 148*a* formed at location corresponding to the recessed space 132 (i.e. right above the recessed space 132). The first layer 144 and the second layer 146 are the second type layers that extend over the opening 148*a* to constitute the deformable portion 142, i.e. that cover the opening 148*a* from the top side, wherein the membrane switch layer 140*e* has a recessed groove on the bottom side, and the recessed groove opens toward the baseplate 130. In other words, the portions of the first layer 144 and the second layer 146 that correspond to the opening 148*a* are the deformable portion 142, which receives the engaging portion 112 and provides the buffering effect. The thickness of the deformable portion 142 equals to the total thickness of the first layer 144 and the second layer 146 (i.e. the second type layers) and preferably equals to or less than 0.075 mm.

Figure 5A:
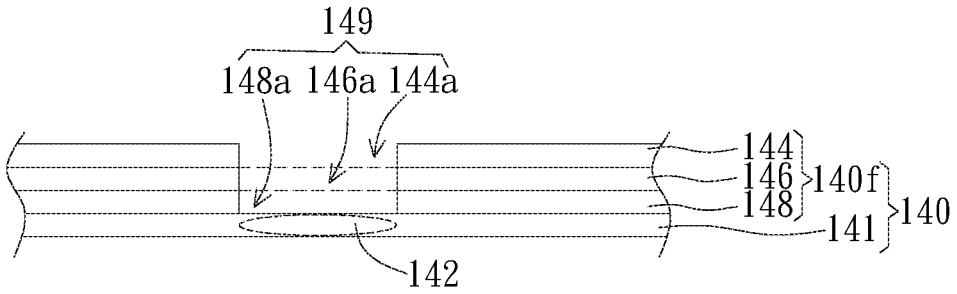
FIGS. 5A and 5B are schematic views of the buffer film according to different embodiments of the invention.
Figure 5B:
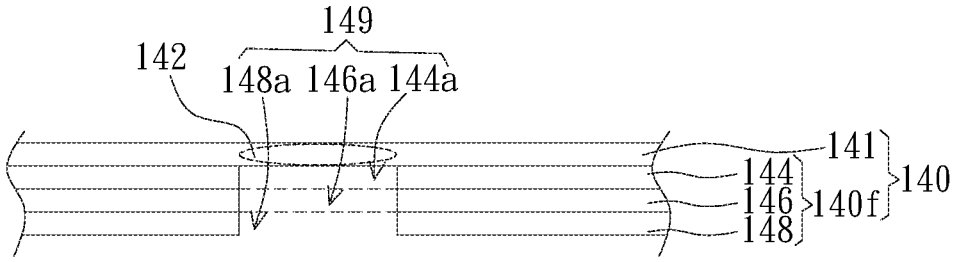

In another embodiment, as shown in FIGS. 5A and 5B, the buffer film 140 includes a membrane switch layer 140*f* and a sheet 141. The membrane switch layer 140*f* has a through hole 149 corresponding to the engaging portion 112, and the sheet 141 extends beneath or over the through hole 149 from one side to serve as the deformable portion 142. When the keycap 110 moves toward the baseplate 130, the engaging portion 112 presses the sheet 141 through the through hole 149 to make the sheet 141 extend into the recessed space 132. Particularly, in the embodiment of FIG. 5A, the sheet 141 extends beneath the through hole 149 to serve as the deformable portion 142, i.e. the sheet 141 covers the through hole 149 from the bottom side. When the keycap 110 moves toward the baseplate 130, the engaging portion 112 passes through the through hole 149 to push the sheet 141 toward the recessed space 132 and make the sheet 141 deform and extend into the recessed space 132 (similar to FIG. 1D). The membrane switch layer 140*f* may have a multiple-layered structure as described above; the first layer 144, the second layer 146, and the third layer 148 have openings 144*a*, 146*a*, and 148*a*, respectively. The openings 144*a*, 146*a*, and 148*a* are aligned and communicate with each other to form the through hole 149 at location corresponding to the recessed space 132. In the embodiment of FIG. 5A, the sheet 141 extends beneath the through hole 149 (i.e. covers the third layer 148 from the bottom side), and the portion of the sheet 141 that is located beneath the through hole 149 (i.e. the portion of the sheet 141 that corresponds to the through hole 149) serves as the deformable portion 142, which receives the engaging portion 112 and provides the buffering effect. In the embodiment of FIG. 5B, the sheet 141 extends over the through hole 149 (i.e. covers the first layer 144 from the top side) and serves as the deformable portion 142, so that the sheet 141 can be further disposed with a plurality of rubber domes for the keyswitches of the keyboard, and the plurality of rubber domes can be assembled onto the baseplate 130 by a single step. That is, the sheet 141 can be the sheet that connects the plurality of rubber domes, i.e. rubber dome sheet. In the embodiment of FIG. 5B, when the keycap 110 moves toward the baseplate 130, the engaging portion 112 presses the sheet 141 to pass through the through hole 149 to make the sheet 141 extend into the recessed space 132. In an embodiment, the sheet 141 can be a polyester sheet or a rubber sheet, and the thickness of the sheet 141 is preferably smaller than the thickness of the membrane switch layer 140*f*. For example, the sheet 141 can be a Mylar sheet, and the thickness thereof is preferably equal to or less than 0.075 mm, but not limited thereto. It is noted that when the deformable portion 142 is made of a material having greater deformability, the thickness of the deformable portion 142 can be larger than 0.075 mm, so that the deformable portion 142 still provides a sufficient deformation amount to absorb the impact noise generated by the engaging portion 112.

Figure 6B:
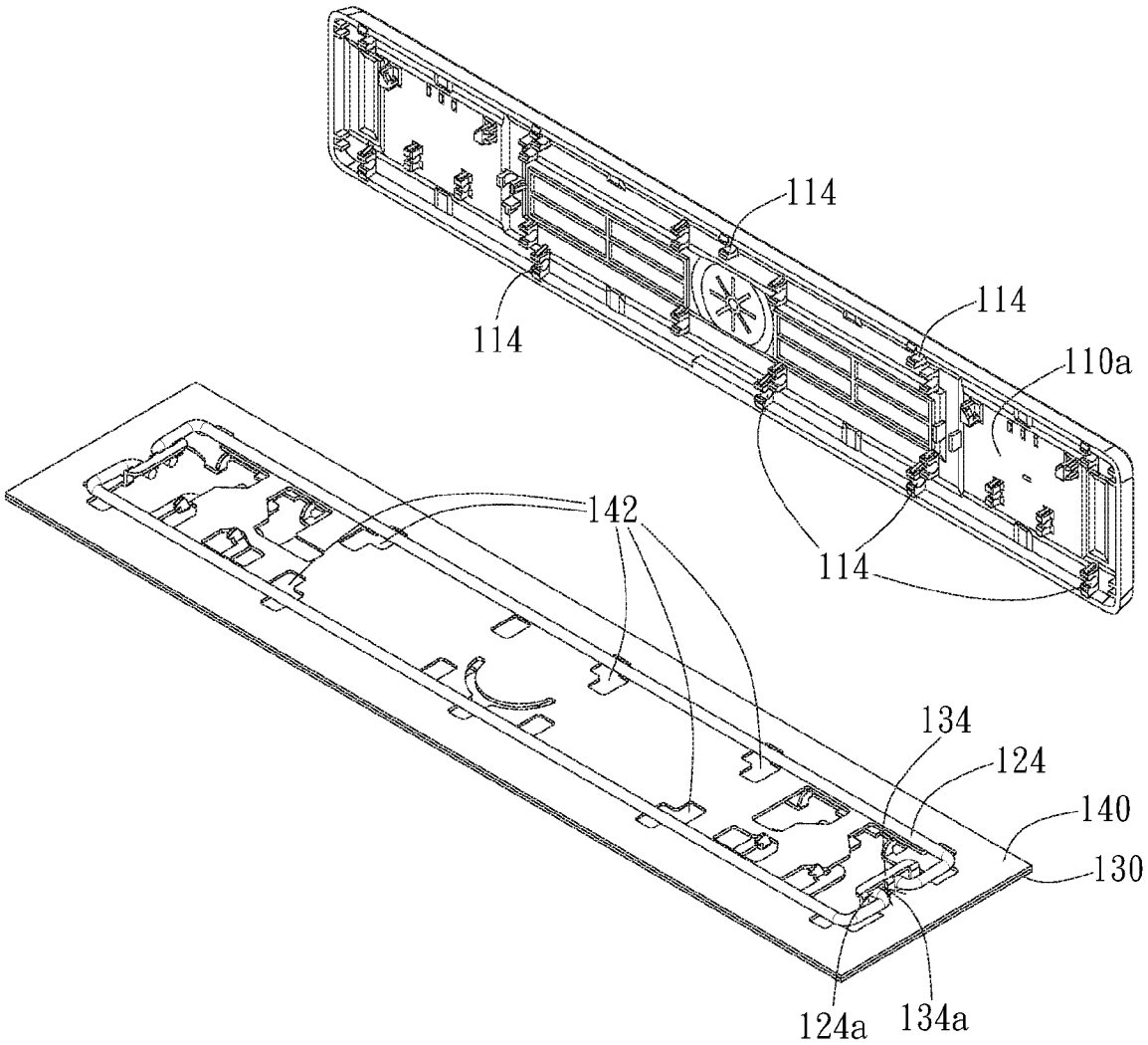
Figure 6C:
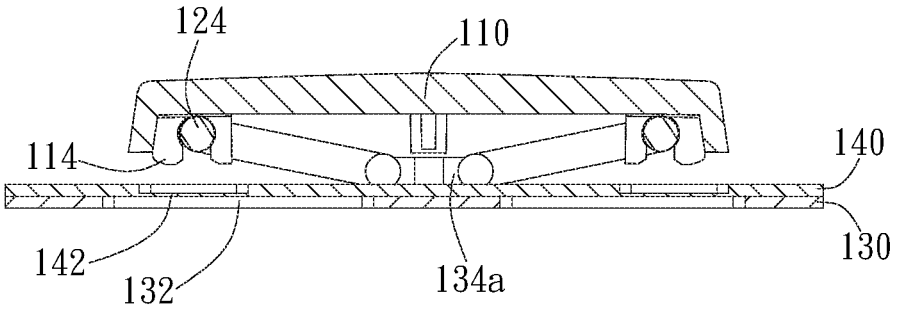
FIGS. 6C and 6D are schematic views of FIG. 6A before and after the keyswitch structure is pressed, respectively.
Figure 6D:
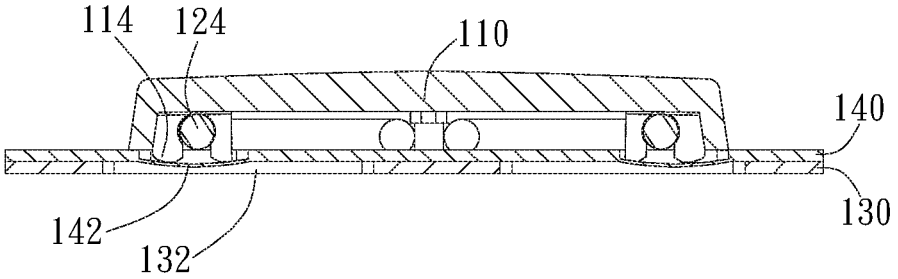

In addition, FIG. 1 illustrates the linking bar 122 only connected to the keycap 110, but according to the key size or design requirements, the linking bar may have different configuration or amount. In another embodiment, as shown in FIG. 6A to 6C, the keyswitch structure 200 of the invention includes a keycap 110, a linking bar 124, a baseplate 130, and a buffer film 140, wherein the keycap 110, the baseplate 130, and the buffer film 140 respectively have the engaging portion, the recessed space 132, the deformable portion 142 as described above, and the buffer film 140 can be embodied as the membrane switch layer 140*a* to 140*e* shown in FIG. 4A to 4E or the combination of the sheet 141 and the membrane switch layer 140*f* shown in FIGS. 5A and 5B. Hereafter, the differences between this embodiment and FIG. 1A will be described in detail. Particularly, the linking bar 124 is connected between the keycap 110 and the baseplate 130. That is, one end of the linking bar 124 is connected to the keycap 110, and the other end of the linking bar 124 is connected to the baseplate 130 to improve the linking effect of the keycap 110. As such, when the user presses the keycap 110 on the right side, the whole keycap 110 including the left side can descend simultaneously to prevent the keycap 110 from exhibiting a slant state with the left side higher and the right side lower. In this embodiment, the linking bar 124 is a U-shaped bar, and two ends of the U-shaped bar each has an extension part 124*a* bending toward the opening of the U-shaped bar. The extension part 124*a* serves as an engaging hook to slidably engage with the baseplate 130. Particularly, in addition to the recessed space 132, the baseplate 130 further includes a connection part 134 for engaging with the extension 124*a* of the linking bar 124. In this embodiment, the connection part 134 is a connection mechanism which is bent upward from the surface of the baseplate 130, wherein the connection part 134 has a slot 134*a*. It is noted that the buffer film 140 correspondingly has an opening 143, which allows the connection part 134 to extend out, so that the extension part 124*a* can be slidably inserted into the slot 134*a*. When the keycap 110 moves relative to the baseplate 130, the extension part 124*a* moves within the slot 134*a* to increase the moving stability of the keycap 110. Corresponding to the configuration of linking bar 124, the keycap 110 has an engaging portion 114 for coupling with the linking bar 124. In this embodiment, a plurality of engaging portions 114 are disposed on the lower surface 110*a* of the keycap 110 to connect corresponding portions of the bar body of the linking bar 124, respectively. Similar to the engaging portion 112, the engaging portion 114 protrudes from the lower surface 110*a* of the keycap 110, and the distal end of the engaging portion 114 extends beyond the bottom surface of the key skirt. It is noted that the engaging portion 114 can be a hook-like structure similar to those in FIG. 2A or FIG. 2B to make the distal end of the engaging portion 114 be lower than the bottom of the linking bar 124 and will not elaborate again. As shown in FIG. 6D, when the keycap 110 moves toward the baseplate 130 to the lower position, the distal end of the engaging portion 114 is lower than the linking bar 124, and the distal end of the engaging portion 114 pushes the deformable portion 142 to make the deformable portion 142 extend into the recessed space 132. By such a design, the keyswitch structure 200 provides the engaging portion 114 of the keycap 110 with enough space for moving downward, and the deformable portion 142 of the buffer film 140 serves like a bouncing pad to absorb the impact noise generated by the engaging portion 114.

Figure 7A:
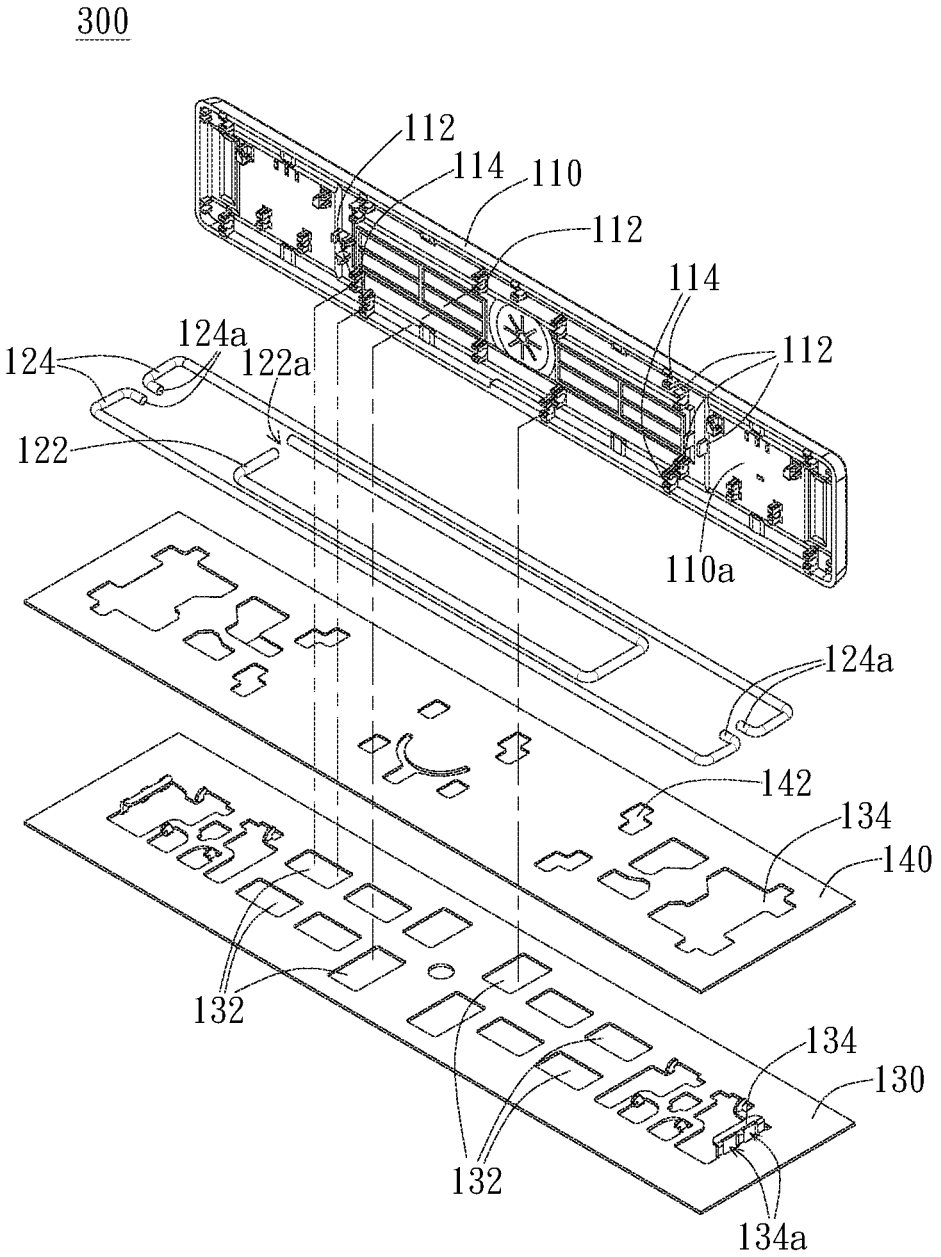
FIGS. 7A and 7B are an exploded view and a partial assembled view of the keyswitch structure according to another embodiment of the invention.
Figure 7B:
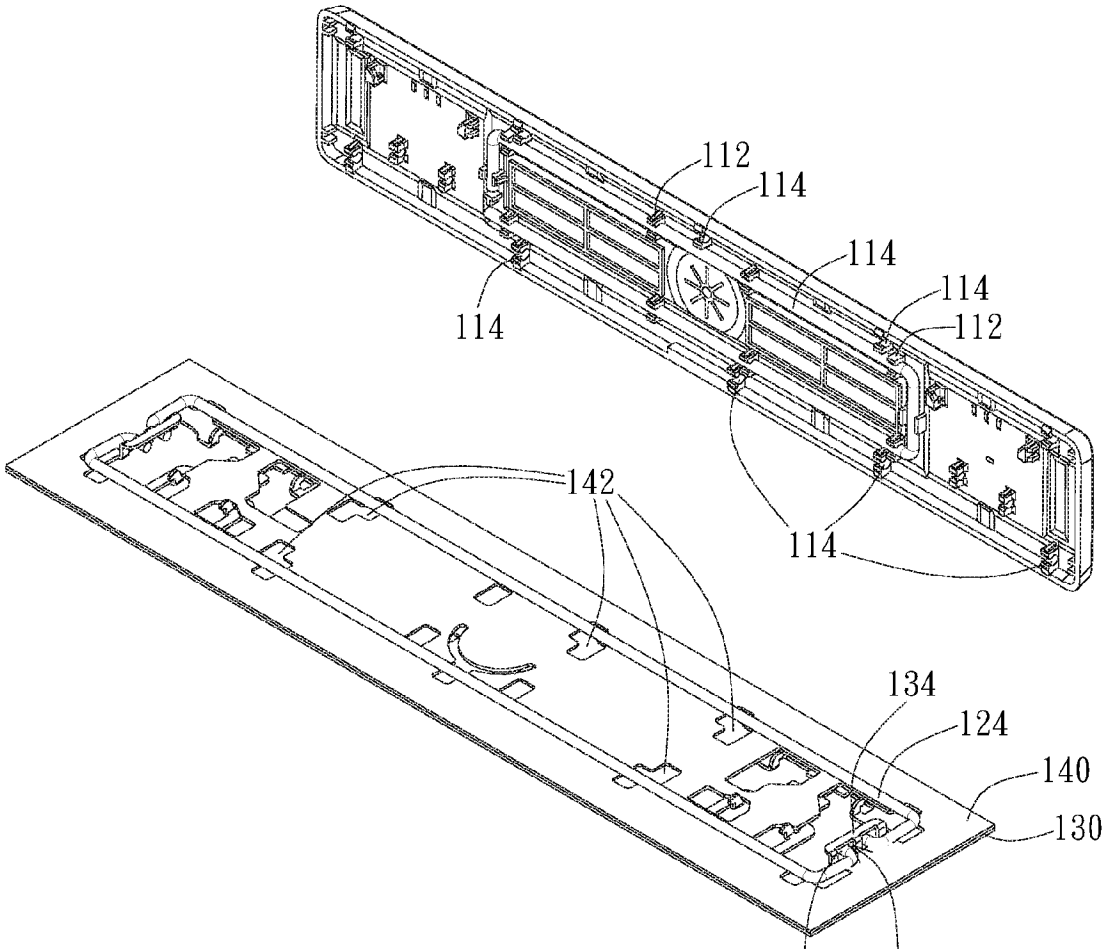
Figure 7C:
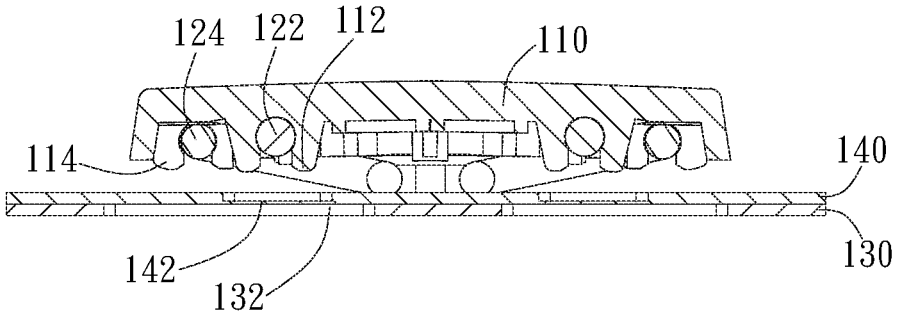
FIGS. 7C and 7D are schematic views of FIG. 7A before and after the keyswitch structure is pressed, respectively.
Figure 7D:
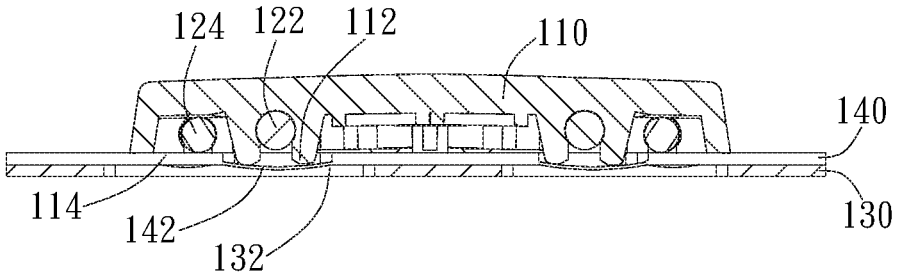

In another embodiment, as shown in FIG. 7A to 7C, the keyswitch structure 300 of the invention includes a keycap 110, linking bars 122 and 124, a baseplate 130, and a buffer film 140. In other words, the keyswitch structure 300 has both the kinking bar 122 of FIG. 1A and the linking bar 124 of FIG. 6A, and the keycap 110 has a plurality of engaging portions 112 and 114. In this embodiment, the linking bar 124 is preferably disposed on an outer side of the linking bar 122 to serve as the connection bar between the keycap 110 and the baseplate 130. That is, the linking bar 124 is neighboring to the edge of the keycap 110, and the linking bar 122 is neighboring to the center of the keycap 110. Moreover, the recessed space 132 of the baseplate 130 and the deformable portion 142 can be designed to have appropriate size and location, so that adjacent engaging portions 112 and 114 can push different parts of a same deformable portion 142 to make different parts of the deformable portion 142 extend into a same recessed space 132 (as shown in FIG. 7D), but not limited thereto. In another embodiment, the recessed space 132 of the baseplate 130 and the deformable portion 142 of the buffer film 140 correspond to the engaging portion 112 or 114 separately, so that the engaging portions 112 and 114 can push different deformable portions 142 and make the deformable portions 142 extend into corresponding recessed spaces 132, respectively.

Figure 8A:
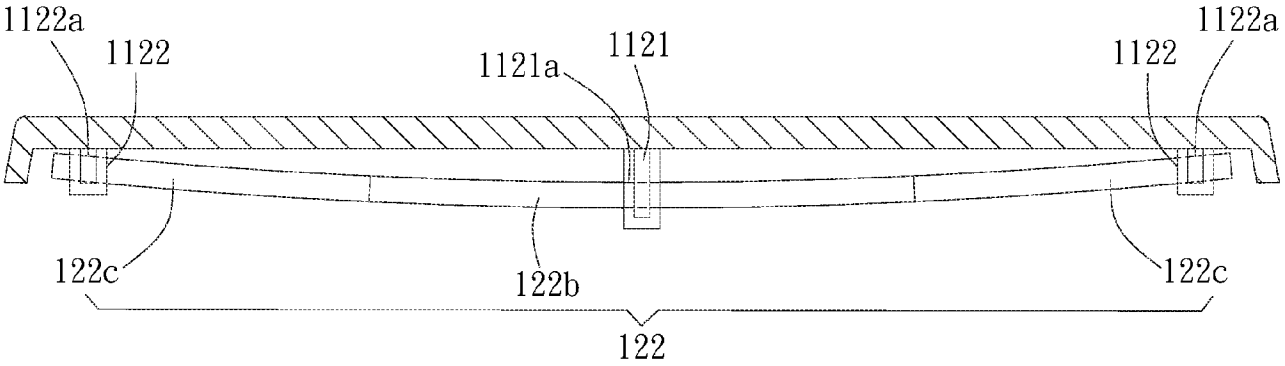
FIGS. 8A and 8B are schematic views of the engaging portion according to different embodiments of the invention.

In an embodiment, as shown in FIG. 8A, the linking bar 122 preferably has a curved cross-section, so that the middle section 122*b* of the linking bar 122 is lower than the two end sections 122*c*. Specifically, the keycap 110 has a longitudinal axis, and the linking bar 122 has a middle section 122*b* and two end sections 122*c* respectively extending from two ends of the middle section 122*b*. The two end sections 122*c* are neighboring to the opposite ends of the longitudinal axis and the middle section 122*b* is neighboring to the center of the longitudinal axis. The two end sections 122*c* are positioned higher than the middle section 122*b*, so the cross-section of the linking bar 122 is curved as U-shaped. Correspondingly, the length of the engaging portion 1121 connected to the middle section 122*b* is larger than the length of the engaging section 1122 connected to the end section 122*c*, and the engaging portion 1121 is disposed closer to the center of the keycap 110 than the engaging portion 1122 is. That is, the distance of the engaging portion 1121 extending from the lower surface 110*a* of the keycap 110 to the bottom of the engaging groove 1121*a* is larger than the distance of the engaging portion 1122 extending from the lower surface of the keycap 110 to the bottom of the engaging groove 1122*a*, so that the linking bar 122 can maintain the U-shaped cross section.

Figure 8B:
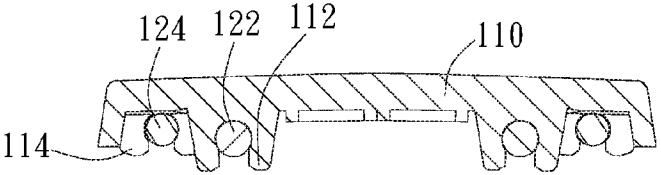

Moreover, the length of the engaging portion 112 that is connected to the linking bar 122 is preferably larger than (as shown in FIG. 8B) or equal to (as shown in FIG. 7C) the length of the engaging portion 114 that is connected to the linking bar 124 disposed on the outer side. Specifically, the engaging portion (e.g. 112) disposed on the inner side of the lower surface 110*a* of the keycap 110 has a larger length than the engaging portion (e.g. 114) disposed on the outer side. That is, from the cross-sectional view shown in FIG. 8B, the engaging portion (e.g. 112) closer to the center of the keycap 110 preferably has a larger length than the engaging portion (e.g. 114) closer to the edge of the keycap 110.

Figure 9:
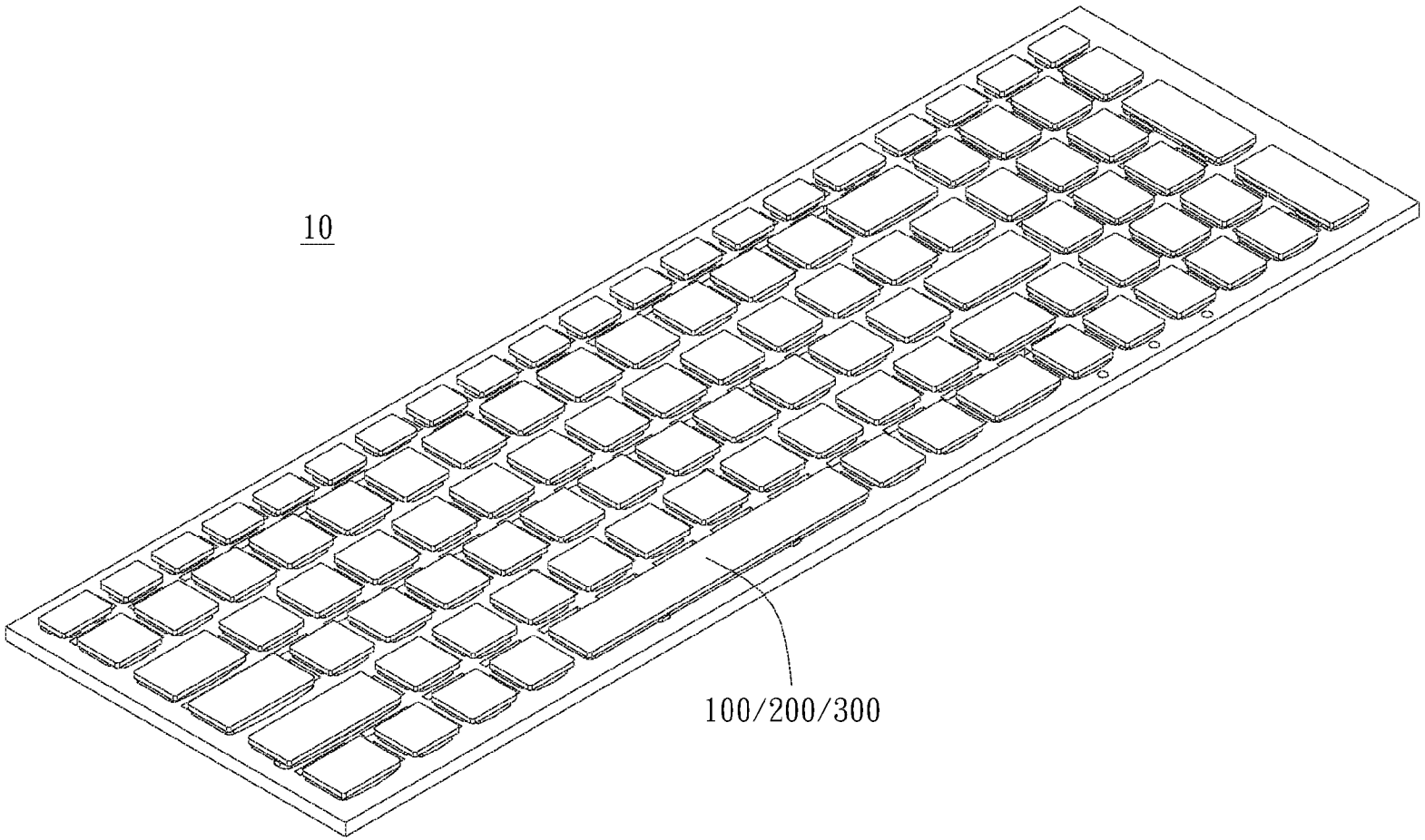
FIG. 9 is a schematic view of the keyboard device according to an embodiment of the invention.

In another embodiment, as shown in FIG. 9, the invention provides a keyboard device 10 including the keyswitch structure 100, 200, and/or 300. The keyboard device 10 can reduce the impact noise by the keyswitch structure 100, 200, or 300, which can provide the buffering effect to prevent the keycap from directly hitting the baseplate during operation. Moreover, the keyboard device 10 can utilize the multiple-layered configuration of the membrane switch layer to achieve the buffering design and effectively reduce the operation noise without increasing the material cost.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A keyswitch structure, comprising:

a keycap having a lower surface and an engaging portion protruding from the lower surface, the engaging portion having an engaging groove, the keycap moving to a lower position when the keycap is pressed;

a linking bar, a portion of the linking bar received in the engaging groove to couple the linking bar with the engaging portion, a distal end of the engaging portion being lower than the linking bar when the keycap moves to the lower position;

a baseplate disposed below the keycap, the baseplate having a recessed space corresponding to the engaging portion; and a buffer film disposed on the baseplate, the buffer film substantially extending over the recessed space and having a deformable portion corresponding to the recessed space, wherein when the keycap moves toward the baseplate to the lower position, the distal end of the engaging portion pushes the deformable portion to make the deformable portion extend into the recessed space.

2. The keyswitch structure of claim 1, wherein the recessed space is a through hole or a groove formed on the baseplate.

3. The keyswitch structure of claim 1, wherein the buffer film is a membrane switch layer comprising at least one first type layer and at least one second type layer, the first type layer has an opening formed at location corresponding to the recessed space, and the second type layer extends over the recessed space to constitute the deformable portion.

4. The keyswitch structure of claim 3, wherein the deformable portion has a recessed groove, the recessed groove opens toward the keycap or the baseplate.

5. The keyswitch structure of claim 3, wherein the deformable portion has two recessed grooves, and the two recessed grooves open toward the keycap and the baseplate, respectively.

6. The keyswitch structure of claim 3, wherein the membrane switch layer comprises multiple second type layers extending over the opening, and a total thickness of the second type layers is equal to or less than 0.075 mm.

7. The keyswitch structure of claim 1, wherein the buffer film comprises a membrane switch layer and a sheet, the membrane switch layer having a through hole corresponding to the engaging portion, the sheet extends over the through hole to serve as the deformable portion, and when the keycap moves toward the baseplate, the engaging portion presses the sheet through the through hole to make the sheet extend into the recessed space.

8. The keyswitch structure of claim 7, wherein the sheet is a polyester sheet or a rubber sheet, and a thickness of the sheet is smaller than a thickness of the membrane switch layer.

9. The keyswitch structure of claim 1, wherein the linking bar comprises a first linking bar and a second linking bar, the engaging portion comprises at least one first engaging portion and a second engaging portion respectively connected to the first linking bar and the second linking bar, the second linking bar is neighboring to an edge of the keycap, the first linking bar is neighboring to a center of the keycap, and a length of the first engaging portion is larger than or equal to a length of the second engaging portion.

10. The keyswitch structure of claim 1, wherein the keycap has a longitudinal axis and a plurality of the engaging portions, the linking bar has a middle section and two end sections respectively extending from two ends of the middle section, the two end sections are neighboring to opposite ends of the longitudinal axis and the middle section is neighboring to a center of the longitudinal axis, and a length of the engaging portion connected to the middle section is larger than a length of the engaging portion connected to the end section.

11. The keyswitch structure of claim 10, wherein the two end sections are positioned higher than the middle section, so the cross-section of the linking bar is curved as U-shaped.

* * * * *